United States Patent [19]

Herrmann

[11] 4,192,692

[45] Mar. 11, 1980

[54] PROCESS FOR REMOVING LAYERS OF SELENIUM

[75] Inventor: Heinz Herrmann, Wiesbaden, Fed. Rep. of Germany

[73] Assignee: Hoechst Aktiengesellschaft, Fed. Rep. of Germany

[21] Appl. No.: 909,561

[22] Filed: May 25, 1978

[30] Foreign Application Priority Data

May 26, 1977 [DE] Fed. Rep. of Germany ..... 2723799

[51] Int. Cl.[2] ..... B08B 3/08

[52] U.S. Cl. ..... 134/2; 134/26; 134/30; 134/42; 252/171; 252/544

[58] Field of Search ..... 134/2, 42, 26, 30; 252/544, 171; 423/510

[56] References Cited

U.S. PATENT DOCUMENTS

| | | | |
|---|---|---|---|
| 2,816,008 | 12/1957 | Stein et al. | 423/510 |
| 2,889,206 | 6/1959 | Hobin | 423/510 |
| 3,837,815 | 9/1974 | Bixby | 423/510 X |
| 3,990,907 | 11/1976 | Endo et al. | 134/2 |
| 3,992,511 | 11/1976 | Waehner et al. | 423/510 |

*Primary Examiner*—Marc L. Caroff

*Attorney, Agent, or Firm*—James E. Bryan

[57] ABSTRACT

A layer of selenium is removed from a metal base by contacting the layer with a fluid which contains an amine or a mercaptan at a temperature in the range between about 60° and 150° C. and then contacting the layer with an inert fluid at a temperature not exceeding 40° C.

13 Claims, No Drawings

PROCESS FOR REMOVING LAYERS OF SELENIUM

The invention relates to a process for removing a layer, which contains amorphous selenium or consists thereof, from a metal base.

In electrophotography, metal bases are known as carriers in the form of plates, cylindrical drums or flexible tapes. The metals used are aluminum, brass, chromium, stainless steel and the like. The surfaces of the bases are in most cases pretreated. Thus, customary aluminum drums may be anodized at least in the edge zones. Because of the necessary surface smoothness and the dimensional accuracy, the metal bases, in particular the drums, represent a special industrial value which should be preserved when the photoconductor layer has worn out.

A recovery of the unaltered carrier base, after the applied layer of selenium has worn out or has been damaged, is therefore of great interest.

The applied photoconductor layer is used for the production of latent electrostatic charge images. Selenium is used largely in the amorphous state. The layers also are composed of doped selenium or of selenium alloys; this has the result of extending the sensitivity of the selenium into the red region of the spectrum. Customarily, arsenic is added. Substances such as halogen, phosphorus, antimony, tellurium and sulfur, are also added. The layers can be present on the metal base as a single layer or as a series of layers.

Various processes are known for separating layers which contain selenium from metal bases. For example, the photoconductor layer can be separated from the base using oxidizing acids, concentrated solutions of alkali metal sulfides or fused alkali metal hydroxides (U.S. Pat. No. 2,816,008). A process is also known for removing the layer, which contains selenium, by cooling the drum to a low temperature in liquid nitrogen (U.S. Pat. No. 3,837,815). Then, the drum is immersed in water and the ice layer formed is thawed. In this case, the selenium layer no longer adheres to the metal but to the ice layer. It is also known to heat the selenium layer together with the carrier base to a temperature slightly below the melting point of the selenium layer and then to spray the coated surface (DT-AS No. 2,549,947).

The known processes, however, exhibit various disadvantages. Thus, when the selenium layer is stripped with aggresive chemical agents, the selenium is converted to toxic selenium compounds, the disposal of which raises problems. Furthermore, a recovery of selenium, which may be carried out, requires additional chemical processes. On the other hand, the surfaces of the metal base are attacked.

However, upon stripping by generating large temperature differences, elemental selenium is recovered afterwards, but strains which lead to troublesome deformations of the outer surfaces, are produced in the metal bases.

It is also known (U.S. Pat. No. 3,990,907) to remove spent selenium layers from metal carriers by treating the photoconductor drums with hot water, steam, trichloroethylene or perchloroethylene, in which case the layer of selenium loses its adhesion, due to the different thermal expansions of selenium and of the base, and can be stripped from the carrier.

A process of this type also utilizes relatively large temperature differences which make it possible for strains to arise in the material, so that this process also does not yet meet all requirements for a problem-free applicability. Moreover, hot water and steam slightly attack carriers composed of aluminum. The use of chlorinated ethylenes raises problems because of their toxicity. During the stripping process itself, sensitive carrier surfaces, for example surfaces of aluminum, are easily damaged.

It is thus the object of the present invention to provide a process for removing a layer, which contains amorphous selenium or consists thereof, from a metal base, by means of which the layer can be separated from the metal base, if possible without a chemical reaction, and in which no damage to the metal base occurs.

In the process of the type initially set forth, this object is achieved by allowing a fluid which contains an amine or a mercaptan to act on the layer at temperatures in the range between about 60° and 150° C. and then treating for cleaning with an inert fluid at a temperature of at most 40° C.

The result of this is that, due to the change in the modification of the selenium during the transition from the amorphous into the hexagonal state, the layer flakes off and is finally removed completely, or almost completely, from the base by a cleaning process, such as, for example, spraying. Because of the relatively small temperature fluctuations during the removal of the layer of selenium, no strains are generated in the metal so that deformations also do not occur.

The fluid which is effective according to the invention and which contains an amine or a mercaptan, can be applied to the layer of selenium in any desired manner, such as by dipping, dip-coating, spraying-on, rubbing-in, pouring-on, or the like.

As the fluids, the amines or mercaptans are employed by themselves or dissolved in or mixed with polyhydric alcohols.

The amines employed are those which, taking the environmental conditions into account, are free from noxious odor, do not possess an excessive basicity and have a high boiling point. Amines of a relatively high basicity also can be employed if direct contact with the metal base is avoided.

Amines which can be used are those from the series of diprimary amines of the general formula

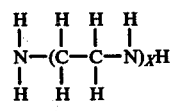

with X being equal to or greater than 2. Diethylenetriamine and triethylenetetramine are here particularly suitable. Moreover, alkyldiamines with at least 5 carbon atoms can be employed, such as trimethylhexamethylenediamine. Heterocyclic bases, such as pyridine, quinoline, morpholine and their alkyl derivatives, in particular those having up to 4 carbon atoms, also have proved to be suitable.

Preferably, 2,2,4-trimethylhexamethylenediamine is employed.

The mercaptans employed are those which also meet the conditions applying in part to amines, such as little odor and a high boiling point.

Examples of mercaptans which can be used are those which correspond to the formula R—S—H, wherein R— represents a straight-chain or branched alkyl group having more than 7 carbon atoms.

Preferably, lauryl mercaptan is employed.

As already stated, amines or mercaptans can be employed by themselves as the fluid acting on the layer. It has been found, however, that it is advantageous to apply the amine or mercaptan in a solution or mixture. For this purpose, polyhydric alcohols are employed which, with respect to their boiling point, meet the temperature conditions required. These include, in particular, glycols, glycerol or glycol ethers.

Solvents or diluents which can be used are hexylene glycol, diethylene glycol, polyethylene glycol, trimethylene glycol, ethylene glycol, propylene glycol, glycerol and also glycol ethers, such as diethylene glycol monoethyl ether.

According to the invention, polyethylene glycol having a molecular weight below about 1,000 is preferably employed. Polyethylene glycol having a molecular weight of 300–400 has proved to be particularly suitable.

The solutions or mixtures can be applied in any desired composition. Preferably, however, a 5 to 50 percent by volume solution or mixture of the amine or the mercaptan with a polyhydric alcohol will be selected.

After the fluid has been applied to the layer of selenium, the whole is heated to a temperature in the range between about 60° and 150° C., for example in an oven. Preferably, the heating is to a temperature in the range from 70°–130° C. This temperature is maintained until the layer of selenium starts to flake off.

Heating also can be carried out in any other desired manner, for example by heating with warm air or by passing steam through the interior of the drum or—provided that it is ensured that the hot fluids do not attack the metal base—by dipping in a heated fluid, and this is preferred according to the invention.

As a result of the treatment, amorphous selenium is converted into metallic selenium which has poor adhesion, and, according to the invention, the fluid accelerates, during its action, the thermal change of modification.

After the thermal treatment, the metal bases are treated for cleaning with an inert fluid at a temperature of at most 40° C., as a result of which the selenium-containing layer, which has not yet flaked off, is removed from the base.

Suitable inert fluids are those fluids which also have been used hitherto for similar purposes, such as lower alcohols or ketones and also liquid lower molecular weight hydrocarbons. Preferably, however, water is employed. It has proved to be very advantageous if cold water of 10°–20° C. is used for removing the layer of selenium.

A residue of selenium which may remain after the flaking-off and removal of the selenium-containing layer, can afterwards be removed using a solvent for selenium. Examples of suitable solvents are aqueous solutions of alkali metal sulfides and alkali metal sulfites or, especially, mixtures composed of 40–98% by volume of amine and 60–2% by volume of alkyl mercaptan.

The invention will be further illustrated by reference to the following Examples:

EXAMPLE 1

A copying drum composed of aluminum and a photoconductor layer of selenium was rubbed with a 1:1 by volume mixture, composed of 2,2,4-trimethylhexamethylenediamine and polyethylene glycol having a molecular weight of 300, with the aid of a cotton wool pad, then stored for 45 minutes in a drying cabinet heated to 90° C., and finally dipped into a basin filled with water. The layer of selenium dropped off the aluminum drum, in the form of flakes. The flakes were washed clean with water and acetone.

A selenium drum which had not been pretreated with the mixture of fluids, showed merely cracks in the layer of selenium, when treated correspondingly; the adhesion was, however, still good.

EXAMPLE 2

Example 1 was repeated with equal success, using a mixture composed of 95 parts by volume of a polyethylene glycol having a molecular weight of about 400 and 5 parts by volume of trimethylhexamethylenediamine.

EXAMPLE 3

A worn-out copying drum, having a photoconductive layer of selenium, was dipped at 100° C. into a mixture, composed of 95 parts by volume of a polyethylene glycol having a molecular weight of about 400 and 5 parts by volume of trimethylhexamethylenediamine. After about 15 minutes, the layer of selenium began to flake off. When the drum was cooled in water at 20° C., the photoconductor layer dropped off almost completely. Remaining residues of selenium were removed using a mixture composed of 50 parts by volume of morpholine and 50 parts by volume of lauryl mercaptan, at 20° C.

EXAMPLE 4

Example 3 was repeated; however, the polyethylene glycol/trimethylhexamethylenediamine mixture was heated to 130° C. The layer of selenium dropped off the aluminum drum after about 5 minutes. The surface of the drum proved to be excellently suitable for new coatings.

EXAMPLE 5

A worn-out copying drum, having a photoconductive layer of selenium on a metal base, was rubbed with lauryl mercaptan and then placed for 45 minutes in an oven at 90° C. When dipping the drum, while still hot, into cold water, the layer dropped off the metal base almost completely. The remaining residues were removed as described in Example 3.

It will be obvious to those skilled in the art that many modifications may be made within the scope of the present invention without departing from the spirit thereof, and the invention includes all such modifications.

What is claimed is:

1. A process for removing a layer, which contains amorphous selenium or consists thereof, from a metal base, which comprises contacting the layer with a first fluid which contains an amine or a mercaptan in an effective amount sufficient to cause flaking-off of said selenium from said metal base, at a temperature in the range between about 60° and 150° C., and then contacting the layer with an inert second fluid at a temperature not exceeding 40° C.

2. A process as claimed in claim 1 in which the amine is a diprimary amine of the general formula

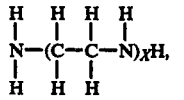

in which X is equal to or greater than 2, or an alkyldiamine having at least 5 carbon atoms.

3. A process as claimed in claim 1 in which the amine is diethylenetriamine, triethylenetetramine, trimethylhexamethylenediamine, pyridine, quinoline, or morpholine.

4. A process as claimed in claim 1 in which the amine is 2,2,4-trimethylhexamethylenediamine.

5. A process as claimed in claim 1 in which the mercaptan has the general formula R—S—H, wherein R is a straight-chain or branched alkyl group having more than 7 carbon atoms.

6. A process as claimed in claim 5 in which the mercaptan is lauryl mercaptan.

7. A process as claimed in claim 1 in which a 5 to 50% by volume solution or mixture of the amine or mercaptan with a polyhydric alcohol is employed as the first fluid.

8. A process as claimed in claim 7 in which glycol, glycerol or glycol ethers, alone or in a mixture, are employed as the polyhydric alcohols.

9. A process as claimed in claim 7 in which polyethylene glycol having a molecular weight between about 300 and 400 is employed as the polyhydric alcohol.

10. A process as claimed in claim 1 wherein the step of contacting the layer with a first fluid is conducted at a temperature in the range from about 70° to 130° C.

11. A process as claimed in claim 1 in which water is employed as the inert fluid.

12. A process as claimed in claim 11 in which the water has a temperature of 10°-20° C.

13. A process as claimed in claim 1 including removing a residue of the layer of selenium, which remains after the cleaning treatment, by contacting the residue with a mixture of 40 to 98% by volume of an amine and 60 to 2% by volume of an alkyl mercaptan.

* * * * *